United States Patent [19]

Wall et al.

[11] Patent Number: 4,869,648

[45] Date of Patent: Sep. 26, 1989

[54] VANE TYPE ROTARY FUEL PUMP

[75] Inventors: Robin C. Wall, Rochester; Stephen J. O'Nien, Gillingham, both of England

[73] Assignee: Lucas Industries Public Limited Company, Birmingham, England

[21] Appl. No.: 167,304

[22] Filed: Mar. 11, 1988

[30] Foreign Application Priority Data

Mar. 21, 1987 [GB] United Kingdom ..... 8706754

[51] Int. Cl.[4] ..... F04B 21/00

[52] U.S. Cl. ..... 417/206; 417/435; 418/15

[58] Field of Search ..... 417/204, 205, 206, 435; 418/15, 82, 184; 123/509, 510, 514, 516

[56] References Cited

U.S. PATENT DOCUMENTS

| | | | |
|---|---|---|---|
| 3,790,314 | 2/1974 | Swain et al. | 418/82 X |
| 4,242,068 | 12/1980 | Shaw | 418/82 X |
| 4,309,151 | 1/1982 | Craven | 417/206 |
| 4,455,126 | 6/1984 | Brotherston | 417/435 X |
| 4,672,937 | 6/1987 | Fales et al. | 123/509 |

*Primary Examiner*—Leonard E. Smith

*Assistant Examiner*—Leonard P. Walnoha

*Attorney, Agent, or Firm*—Balogh, Osann, Kramer, Dvorak, Genova & Traub

[57] ABSTRACT

A fuel pumping apparatus includes a high pressure pump and a low pressure pump contained in a housing and driven by a drive shaft which is coupled to a rotary part of an internal combustion engine. The low pressure pump is a vane pump having a rotor in which is formed a plurality of outwardly extending slots which accommodate outwardly spring loaded vanes. The edges of the vanes engage an eccentrically disposed surface formed on a stator. The pump has end plates and inlet and outlet ports communicating with the space defined between said surface and the outer surface of the rotor. The outer edges of each vane are formed with grooves which extend along the edges and the grooves communicate by way of passages with the inner ends of the respective slots. Side plates are disposed at the opposite ends of the rotor and one of the side plates has an opening which is positioned after the inlet port in the direction of rotation of the rotor, the opening being positioned below the normal level of fuel in the housing and communicating in turn with the inner ends of the slots.

4 Claims, 3 Drawing Sheets

VANE TYPE ROTARY FUEL PUMP

This invention relates to a fuel pumping apparatus for supplying fuel to a compression ignition engine, the apparatus including a high pressure pump which is driven in use in synchronism with an associated engine and which has a plurality of outlets connected in use to the injection nozzles of the engine, a low pressure pump for supplying fuel to the high pressure pump, the low pressure pump and the high pressure pump being located in a housing and the rotary parts thereof being connected in use to a rotary part of the engine by a drive shaft, the low pressure pump being of the vane type and including a rotor which is coupled to the drive shaft, the rotor being located between a pair of side plates and a surrounding stator, a plurality of slots in the rotor and vanes located in the slots respectively, the outer faces of the vanes in use engaging the inner surface of the stator, and serving to draw fuel through an inlet port and expel fuel through an outlet port as the rotor is rotated.

Such apparatus is well known in the art, the inlet port being connected to a fuel supply tank and the outlet port being connected to the fuel inlet of the high pressure pump. In the use of the apparatus fuel collects within the housing of the apparatus by reason of leakage and the surplus fuel is returned to the supply tank. In many cases a small flow of fuel into the housing from the outlet of the low pressure pump, is arranged deliberately since this can be used to reduce the amount of air which is passed to the high pressure pump.

When the fuel supply tank is exhausted large volumes of air will be supplied to the high pressure pump and the associated engine will stop due to fuel starvation. In order to start the engine after refilling the fuel tank, the latter may be cranked by the starting motor but this will impose a heavy load on the starting motor and the electrical storage accumulator.

It has been proposed to utilize the volume of fuel remaining in the housing to enable the associated engine to be operated at a low speed thereby to reduce the load on the starting motor and the accumulator and to speed up the process of purging air from the apparatus. Such proposals have in some cases relied on pressure operated valves and in other cases on the fuel distribution in the housing to ensure that firstly the operator is made aware of the fact that the engine is starved of fuel and secondly that the operator cannot use the volume of fuel within the housing to maintain operation of the engine.

The object of the present invention is to provide an apparatus of the aforesaid kind in a simple and convenient form.

According to the invention an apparatus of the kind specified is characterised in that the outer faces of the vanes are shaped to define a pair of edges for engagement with the inner surface of the stator in turn as the rotor rotates, each vane is provided with a passage extending from between said edges to the inner face of the vane, and an aperture is provided in one of said side plates, the aperture opening into the interior of the housing at a position to be below the fuel level therein and also opening onto the side face of the rotor at a position to communicate in turn with the inner ends of the slots therein, the aperture being positioned following the inlet port in the direction of rotation of the rotor.

An example of a fuel pumping apparatus in accordance with the invention will now be described with reference to the accompanying drawings in which.

Figure 1:
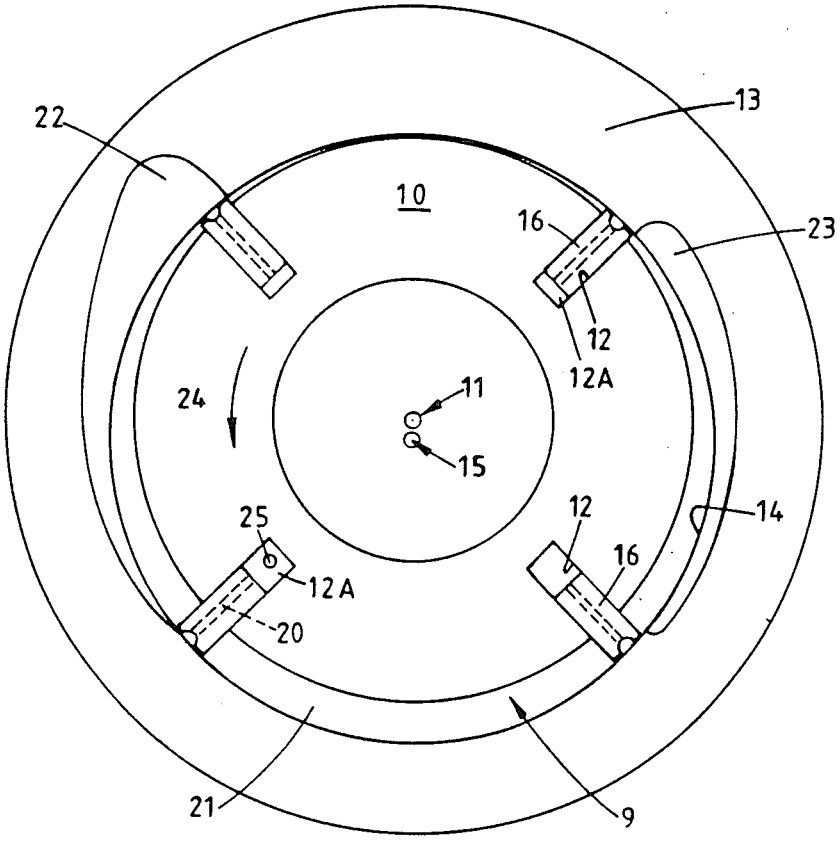
FIG. 1 is a side view of a vane pump forming part of the apparatus, with a part removed for the sake of clarity.

Referring to the drawings the vane pump comprises a rotor 10 which is mounted for rotation about an axis 11 and formed in the rotor are, in the particular example, four radially disposed slots 12. Surrounding the rotor is a liner 13 having a cylindrical inner surface 14 which is eccentrically disposed relative to the rotor, the centre from which the surface 14 is generated, being indicated at 15.

Figure 2:
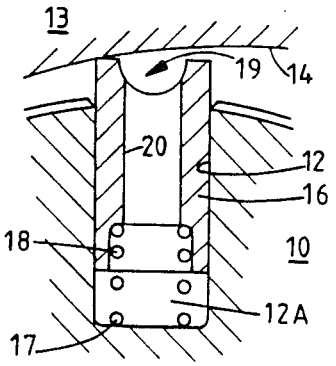
FIG. 2 is a section through a portion of the pump seen in FIG. 1.
Figure 3:
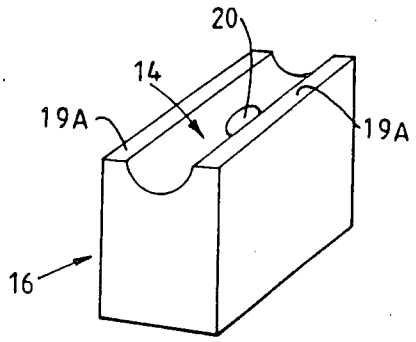
FIG. 3 is a perspective view of part of the pump shown in FIGS. 1 and 2.

Located in each slot is a vane 16, the vanes being mounted in sliding relationship within the slots and being resiliently biased outwardly as shown in FIG. 2, by coiled springs 17, the springs being partly located within a recess 18 formed in the inner end face of the vane. It will be understood that other forms of spring e.g. leaf springs, may be used. The outer face of each vane is shaped so as to form two edges 19A for engagement in turn as the rotor rotates with the surface 14. In the particular example the outer face of each vane is formed with a groove 19 which as will be seen from FIG. 3, extends the length of the vane and extending from the groove to the inner end face of the vane is a passage 20. The vane may have a flat outer face in which case the end of the passage which opens onto the face may be countersunk.

The assembly of the pump is completed by a pair of end plates the side face of one of the plates being shown at 9, the plates serving to close the space 21 which is defined between the outer surface of the rotor and the cylindrical surface 14 and as is usual, the rotor has a small working clearance with the end plates as also do the side faces of the vanes.

Formed in the liner 13 are inlet and outlet ports 22, 23 respectively it being appreciated that the ports may, if required, be formed in the aforesaid end plates.

The direction of rotation of the rotor is as indicated by the arrow 24 and as the rotor rotates, fluid will flow into the space 21 through the inlet port 22, and will be expelled from the space through the outlet port 23 in the usual manner of a vane pump. The passages 20 within the vanes ensure that the forces generated by fluid pressure acting on the vanes, are substantially balanced and therefore the forces acting to urge the vanes outwardly are largely due to the action of the springs 17. Furthermore, as the vanes move inwardly as they move in the region of the outlet 23, fluid is displaced from the spaces 12A at the inner ends of the slots through the passages 20 and similarly when the vanes are moving in the vicinity of the inlet port 22 fluid can flow into the inner ends of the slots by way of the passages 20.

The displacement of fluid by the movement of the vanes within the slots contributes to the overall output of the pump and provides a pump with a significantly higher output than a pump in which the vanes are not provided with the passages 20. Moreover, as compared with the latter forms of pump the leakage paths within the pump are reduced. This is because in the latter form of pump the inner ends of the slots are connected together usually by a groove in the end face or end faces of the rotor and in addition are often connected to the outlet. The grooves contribute to the leakage within the pump. Moreover it is only necessary for the vanes which are subject to the high pressure at their outer ends which need to have a balancing high pressure at their inner ends. In the case where the inner ends of the slots are connected together and to the outlet the vanes which are operating in the region of the inlet port are urged outwardly not only by the spring force but also by the high pressure which leads to high contact pressure and unnecessary wear and friction. In the pump as described the vanes are more or less pressure balanced and so it is only the spring force which provides the contact pressure between the vanes and the surface 14.

The number of vanes can of course be increased but the minimum number of vanes is three. If the number of vanes is increased and/or the vane thickness increased the output of the pump will be increased. The surface 14 instead of being circular as in the example, can be modified to so-called "constant chordal form" or constant blade acceleration form etc.

Figure 4:
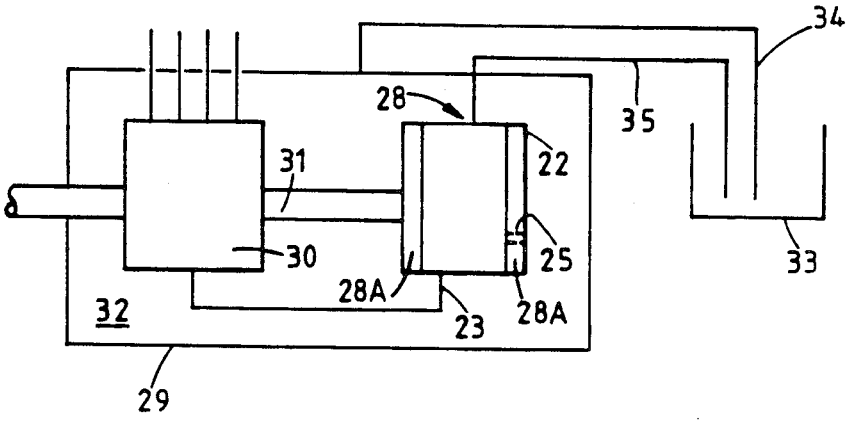
FIG. 4 shows in diagrammatic form a fuel injection pumping apparatus which incorporates the pump.

With reference to FIG. 4 the low pressure pump as described is indicated at 28 and is intended to be mounted in the housing 29 of a fuel injection pumping apparatus for supplying fuel to an internal combustion engine. The inlet of the pump 28 is connected by a pipeline 35 to the supply tank 33. The pump 28 supplies fuel to a high pressure reciprocable plunger pump 30 forming part of the apparatus and in one example the rotor 10 is provided with a splined opening which is mounted about a splined drive shaft 31 of the apparatus. The high pressure pump 30 is supplied with fuel at intervals during each revolution of the drive shaft, the number of intervals depending upon the number of engine cylinders and if for example the engine has four cylinders and the pump 28 as described has four vanes it is possible to "phase" the two pumps so that the pressure peaks or pulses which appear at the outlet port 23 coincide with the filling intervals of the high pressure pump to ensure filling thereof.

In a fuel pumping apparatus for an engine the housing 29 of the apparatus defines a space 32 in which fuel collects in use and which is vented to the fuel supply tank 33 through a pipe 34. The fuel collecting in this space may be due to leakage from the high pressure pump but often it is due to fuel escaping from pressure operated devices within the housing and in some cases due to a deliberate bleed of fuel from the pump as described. This volume of fuel can be utilized to assist the rapid restarting of the engine when air has been introduced into the fuel system due for example to allowing the fuel supply tank to empty.

In order to perform this duty it is essential that the low pressure pump 28 should not draw any appreciable amount of fuel from the space prior to the engine stopping due to fuel starvation. Moreover, on attempting to restart the engine it is essential that the low pressure pump 28 should start to draw fuel from the replenished fuel tank as soon as rotation of the rotor takes place.

A modification to the low pressure pump as described can fulfil the requirements above. If a small hole is provided in one of the end plates 28A, the hole being positioned to communicate with the spaces 12A at the inner ends of the slots 12 in turn, and the hole communicating with the aforesaid space 32 preferably by arranging that the end plate forms a wall of said space, then when a slot 12 registers with the hole fuel can flow through the hole into the slot.

In FIG. 1 a hole is indicated at 25 and in the situation where the fuel supply tank 33 has been allowed to run dry the pump will not produce any suction at the inlet port 22. As a slot 12 is brought into register with the hole 25 very little fuel will flow through the hole because in addition the size of the hole is deliberately made small. If however the fuel tank is replenished then suction will be produced because the pipe 35 is covered, at the inlet 22 with the result that when a slot 12 passes the hole 25 some fuel will be drawn through the hole into the space 12A by suction and this fuel will be supplied to the outlet port 23 as the vane is moved inwardly and will be supplied to the high pressure pump 30. When the slot is not in communication with the hole the operation of the pump applies suction to the fuel supply pipe 35 and draws fuel from the supply tank.

The hole 25 serves also to wet the parts of the pump to enhance the priming performance. Providing the associated vane has moved past the inlet port 22 the suction performance of the pump should not be reduced if the fuel in the space in the apparatus is exhausted. However, if the hole 25 is positioned further in the clockwise direction it is possible for the hole 25 to be exposed to the slot before the vane in the slot has moved past the inlet port. In this case fuel is still drawn through the hole by the suction developed by the pump but if the fuel in the space 32 is exhausted there is a risk that the suction developed in the supply pipe may be lost.

Figure 5:
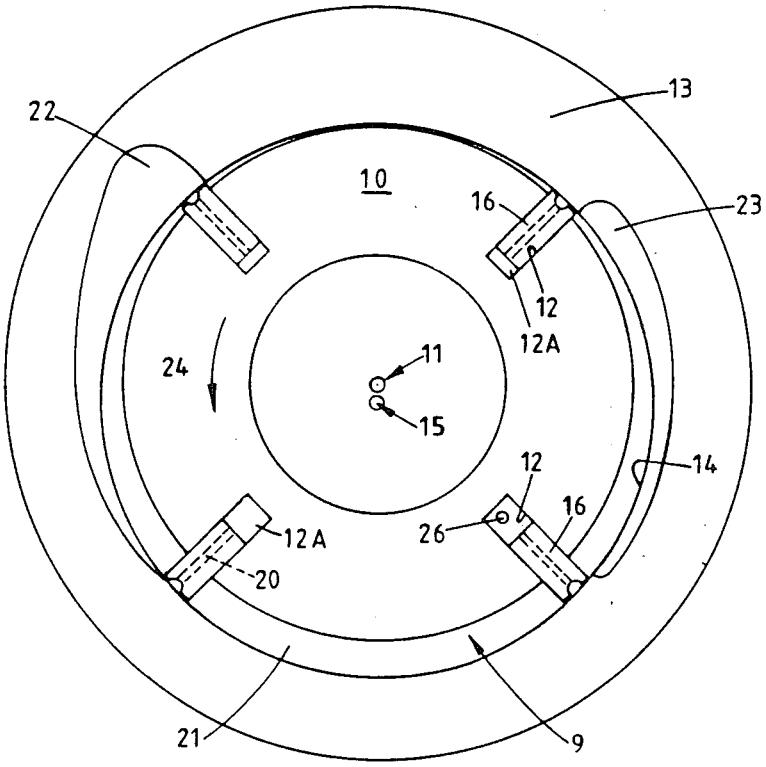
FIGS. 5 and 6 show alternate embodiments of the pump shown in FIG. 1.

The hole can be moved in the anticlockwise direction and provided the hole as shown in FIG. 5 is closed before the vane 16 reaches the outlet port 23 the pump should work as described. If the hole is positioned so that it registers with the slot after the vane has moved past the entrance to the outlet 23 the fuel can flow into the slot to wet the vane and enhance the suction performance but in the normal operation of the pump fuel will be lost through the hole 26 to the space within the apparatus. The suction performance of the pump will not be impaired and the improved efficiency of the pump will more than take care of the loss which in some instances might be useful in assisting in the removal of air from the pump.

Figure 6:
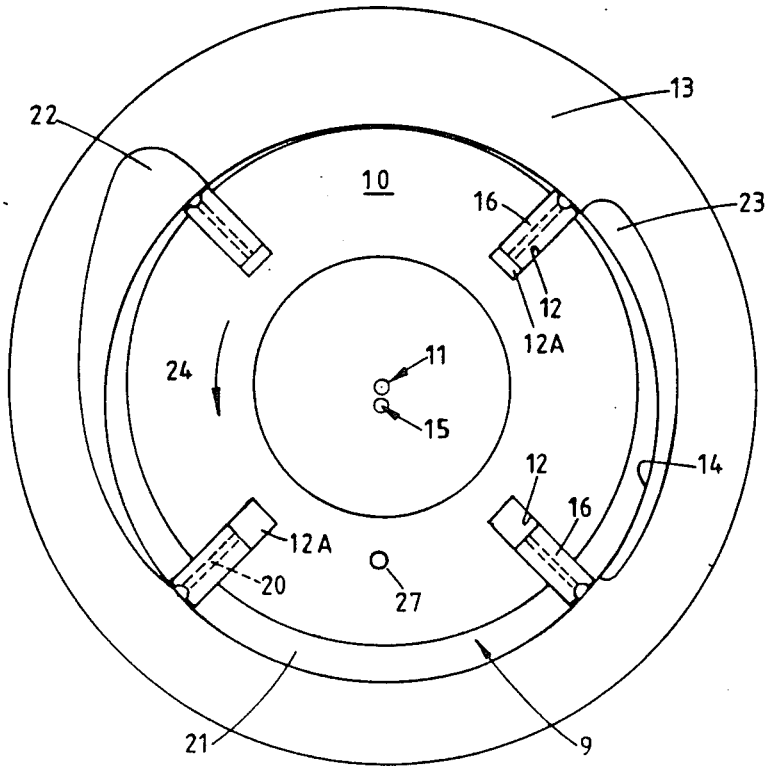

The hole can be positioned at the lowest point as shown at 27 in FIG. 6, to make full use of the fuel contained in the space in the apparatus.

The volume of fuel drawn through the hole is arranged to be barely capable of allowing idling of the engine otherwise the fuel in the space 32 could be exhausted before the engine stops following fuel run out. This small volume of fuel will be sufficient to achieve a partial restart of the engine i.e. the engine will run possibly with assistance from the starter motor, at a speed below the normal idling speed. With the engine operating at a speed above its cranking speed the low pressure pump 28 will be able to draw fuel from the replenished fuel tank 33 more quickly and the fact that the various surfaces of the pump are wet with fuel will enhance the pumping action.

We claim:

1. A fuel pumping apparatus for supplying fuel to a compression ignition engine including a high pressure pump which is driven in synchronism with an associated engine and which has a plurality of outlets connected to the injection nozzles of the engine, a low pressure pump for supplying fuel to said high pressure pump, said low pressure pump being located in a housing in which fuel may accumulate, rotary parts of said low pressure pump being connected to a rotary part of said engine by a drive shaft, said low pressure pump being of the vane type and including a rotor which is coupled to said drive shaft, said rotor being located between a pair of side plates and a surrounding stator, a plurality of slots in said rotor, and vanes located in said slots respectively, the outer faces of said vanes in use engaging an inner surface of said stator, thereby drawing fuel through an inlet port and expelling fuel through an outlet port as the rotor is rotated, the outer faces of said vanes being shaped to define a pair of edges for engagement with said inner surface of said stator upon rotor rotation, each vane provided with a passage extending from between said edges to an inner face of said vane, and an aperture provided in one of said side plates, said aperture opening into the interior of the housing at a position to be covered by fuel therein and also opening onto one of said side faces of said rotor at a position to communicate in turn with inner ends of said slots, said aperture being positioned following said inlet port and proceeding said outlet port in the direction of rotor rotation.

2. A apparatus according to claim 1 characterised in that the edges are defined by a groove formed in the outer face of the vane.

3. An apparatus according to claim 1 characterised in that the aperture is situated at the lowest point in the end plate.

4. An apparatus according to claim 2 characterized in that the aperture is situated at the lowest point in the end plate.

* * * * *